US012352520B2

(12) United States Patent
Minnis et al.

(10) Patent No.: US 12,352,520 B2
(45) Date of Patent: Jul. 8, 2025

(54) MAGAZINE AMMUNITION ROUNDS DETECTION AND ALERT MODULE

(71) Applicants: Tom Minnis, Sunnyvale, CA (US); Dennis Jump, Crossville, TN (US)

(72) Inventors: Tom Minnis, Sunnyvale, CA (US); Dennis Jump, Crossville, TN (US)

( * ) Notice: Subject to any disclaimer, the term of this patent is extended or adjusted under 35 U.S.C. 154(b) by 58 days.

(21) Appl. No.: 17/984,105

(22) Filed: Nov. 9, 2022

(65) Prior Publication Data

US 2023/0144065 A1 May 11, 2023

Related U.S. Application Data

(60) Provisional application No. 63/277,445, filed on Nov. 9, 2021.

(51) Int. Cl.
*F41A 9/62* (2006.01)

(52) U.S. Cl.
CPC ..... *F41A 9/62* (2013.01)

(58) Field of Classification Search
CPC .... F41A 9/62; F41A 19/01; F41A 9/70; F41A 9/65; F41A 35/00
See application file for complete search history.

(56) References Cited

U.S. PATENT DOCUMENTS 5,052,138 A * 10/1991 Crain ..... F41A 9/62 42/1.02
10,619,958 B2 * 4/2020 Masarik ..... F41A 9/62
10,962,314 B2 * 3/2021 Hedeen ..... F41A 9/62
2015/0113847 A1 * 4/2015 Acarreta ..... F41A 9/62 42/1.01
2016/0069629 A1 * 3/2016 Seckman ..... F41A 9/62 42/1.01
2016/0169608 A1 * 6/2016 Schulz ..... F41A 33/02 434/22
2018/0299217 A1 * 10/2018 Hedeen ..... F41C 23/10
2019/0277590 A1 * 9/2019 Masarik ..... F41A 9/70
2019/0390932 A1 * 12/2019 Schulz ..... F41A 33/02
2020/0025479 A1 * 1/2020 Masarik ..... G01D 5/12
2023/0144065 A1 * 5/2023 Minnis ..... F41A 9/62 42/1.02
2023/0213295 A1 * 7/2023 Masarik ..... F41A 9/62 42/1.02
2024/0344790 A1 * 10/2024 Masarik ..... G01D 5/12

* cited by examiner

*Primary Examiner* — Michael D David
(74) *Attorney, Agent, or Firm* — Cynthia S. Lamon; Lamon Patent Services

(57) ABSTRACT

A module for detecting and notifying of the presence of ammunition in an ammunition magazine is provided, comprising a spring and a follower for containing and advancing ammunition within the magazine. A printed circuit board having electronics mounted thereon is mounted in a handle of a gun and includes a central processing unit with access to memory having executable instruction data thereon, at least one motion sensor for sensing motion of the printed circuit board, an eccentric motor, a connector providing remote digital access to the processor, at least one mechanism for erasing data or resetting parameters, and a battery bay for accepting a battery, at least one sensor for detecting position of the spring or follower. An amount of ammunition is thereby discerned by the central processing unit based upon the position of the spring or follower.

20 Claims, 8 Drawing Sheets

This drawing is to help illustrate, in a graphical way, how the system senses the status of the mag.

MAGAZINE AMMUNITION ROUNDS DETECTION AND ALERT MODULE

CROSS-REFERENCE TO RELATED DOCUMENTS

The present invention claims priority to a U.S. provisional patent application Ser. No. 63/277,445, entitled AMMUNITION PRESENCE DETECTOR filed on Nov. 9, 2021, disclosure of which is included herein.

BACKGROUND OF THE INVENTION

1. Field of the Invention

The present invention is in the field of firearms accessories and pertains particularly to methods and apparatus for detecting the presence of ammunition rounds in a spring-loaded magazine and providing notification thereof to a user.

2. Discussion of the State of the Art

Since the evolution of firearms, continued modification of firearms has been an ongoing process. Modern firearms use a magazine sometimes referred to as a clip for storing ammunition or rounds and feeding that ammunition to the chamber of the firearm as required in a semiautomatic mode or in an automatic mode. A typical magazine for a semiautomatic firearm, for example, is a rectangular box device that holds individual rounds aligned in a same direction and stacked upon one another inside the structure. The top of the magazine is open interfaces with the firing chamber of the firearm. The bottom of the magazine is closed.

A disconnected platform called a follower in the art fits inside the magazine structure, and the ammunition rounds are loaded onto the follower from the top of the magazine. A stiff spring termed a follower spring is installed beneath the follower at one end and to the inside surface of the closed end piece of the magazine. In process, the ammunition rounds are loaded against spring tension into the top of the magazine and the magazine is inserted into a magazine compartment or hold and may be locked into the hold to properly interface with the ammunition firing chamber. When a round is fired from a firearm equipped with the magazine, a next ammunition round automatically advances from the magazine into the chamber because of the constant spring pressure exerted against the ammunition stack held within the magazine.

One challenge with magazine ammunition feeders is that a user shooting may not be aware of the ammunition load in a magazine and may inadvertently run out of ammunition being required to eject an empty magazine and insert a fresh magazine before resuming fire. This may occur at an inopportune moment that may place the user in extreme danger if engaged, for example, in an action against one or more individuals that are shooting their firearms back at that user. While some manufacturers have attempted to create ammunition accounting systems integrated with firearms, typically they are bulky and inaccurate. Inaccuracies may be caused by audio detection methods or weapon recoil detection methods that may mistake audio and shock instances during a firing session for firing instances though they may have been natural phenomena. Moreover, smart firearm systems may be permanent control systems requiring the user to engage the system in order to use the firearm at all.

Therefore, what is clearly needed is a modular ammunition presence detector for a firearm magazine that is accurate and may notify the user of low or no ammunition while the user is engaged in session using the firearm.

BRIEF SUMMARY OF THE INVENTION

According to an embodiment of the present invention, a module for detecting and notifying of the presence of ammunition in an ammunition magazine is provided and includes a printed circuit board having electronics mounted thereon including a central processing unit with access to memory having executable instruction data thereon, at least one motion sensor for sensing motion of the printed circuit board, an eccentric motor, a pin connector providing remote digital access to the processor, at least one push button for erasing data or resetting parameters, and a battery bay for accepting a battery, at least one sensor for detecting the presence of ammunition, and a retainer plug attached to the printed circuit board and adapted to stabilize the board inside the structure of a firearm stock.

In one embodiment, the at least one motion sensor may be an accelerometer. In one embodiment, the at least one sensor for sensing ammunition is a Colpitts oscillator. In another embodiment, the at least one sensor for sensing ammunition is a Hall magnetic sensor. In one embodiment, the eccentric motor is a vibrating motor. In a variation of the embodiment using at least one Hall sensor, there are two Hall sensors one sensing a magazine body Magnet and the other sensing a follower Magnet, the magnets are embedded within the ammunition magazine.

In one embodiment, the executable instruction data is firmware. In one embodiment, the retainer plug attaches to the printed circuit board at one end and fits into a structural pocket within a grip stock of a pistol. In one embodiment, the battery is a 3V lithium coin cell. In the embodiment using the Colpitts oscillator, the detection of ammunition depends upon confirming a frequency equal to an approximation of an advancing edge of a metal follower spring within the magazine. In the embodiment using the Hall sensor, the detection of ammunition depends upon confirming line of sight position of an advancing Magnet embedded in a follower within the magazine.

According to one embodiment of the present invention, a method of using a module comprising a printed circuit board having electronics mounted thereon including a central processing unit with access to memory having executable instruction data thereon, at least one motion sensor for sensing motion of the printed circuit board, an eccentric motor, a battery bay for accepting a battery, and at least one sensor for detecting the presence of a magazine and ammunition, to detect and provide confirmation of detection of a number of ammunition rounds remaining in an ammunition magazine coupled to a firearm is provided including the acts (a) picking up the firearm with the module inserted therein, (b) placing an ammunition magazine into a magazine pocket in the firearm, (c) monitoring for recoil motion identifying a shot and recording instances thereof, (d) detecting an event equated to a specific number of ammunition rounds linearly stacked on a follower within the magazine, and (e) upon detection at (d), notifying a user of the firearm the state of ammunition presence remaining within the magazine.

In one aspect of the method in (a) an accelerometer detects the motion of picking up the firearm and wakes the central processing unit. In this aspect, in (b) a first magnetic sensor detects the presence of a magazine with ammunition. In one aspect of the method, in (c), the instances of recorded shots are time stamped. In one aspect, in (d), the number of rounds left in the magazine is equated to a frequency based on approximation of the edge of a follower spring to the ammunition presence detection oscillator on the printed circuit board. In another aspect, in (d) the number of rounds left in the magazine is equated to a magnetic connection between a Hall magnetic sensor and a target magnet embedded in the follower. In one aspect, in (d) notification is provided by executing an eccentric motor to vibrate according to executable instruction data on memory accessible to the central processing unit. In a variation of this aspect, in (d) notification repeats each time step (c) occurs after the first notification, each subsequent notification subtracting the shot fired from the number of rounds cited in the first notification. In a variation of this aspect, in (d), the number of rounds cited is four rounds.

DETAILED DESCRIPTION OF THE INVENTION

In various embodiments described in enabling detail herein, the inventor provides a unique system for detecting the presence of ammunition rounds in a magazine as the magazine is being used and providing notification to the user of an accurate presence of remaining rounds during use of the firearm.

The present invention is described using the following examples, which may describe more than one relevant embodiment falling within the scope of the invention. A goal of the present invention is to provide a modular system that detects when a low number of rounds down to one round remain in the magazine without requiring knowledge of a number of rounds that were in the magazine before use. The invention also notifies at least a user by way of visual, audio, vibratory means, or a combination of those when a magazine being used is empty, low, or almost spent. Another goal of the invention is to provide a record of session use of a firearm recording the number of shots fired (spent ammunition) and the direction the firearm was pointed in when each shot was fired. Still another goal of the invention is to provide location data over a data network of a user active in operating a firearm. These and other goals of the invention are described in detail in the following examples.

Figure 1:
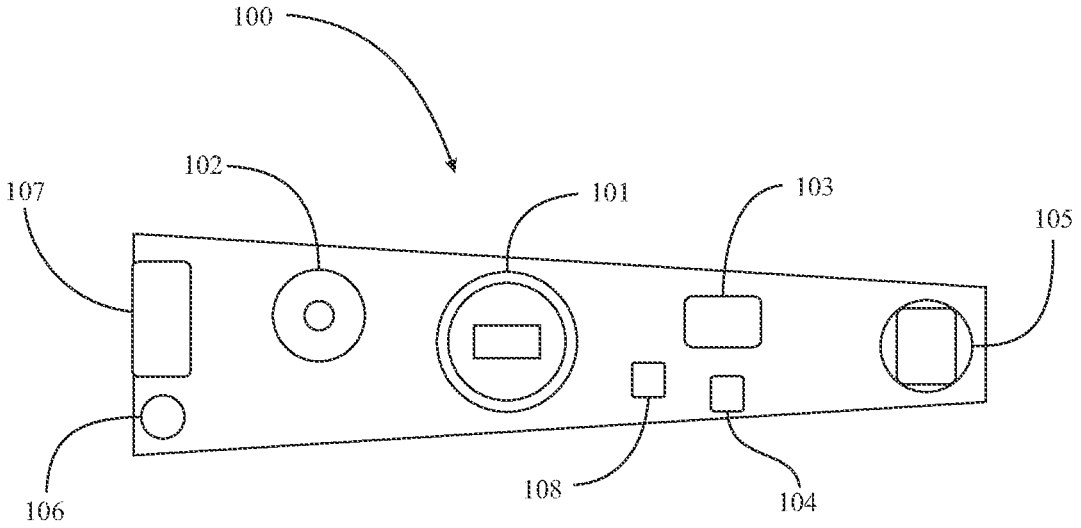
FIG. 1 is an overhead view of an ammunition presence detector and notification module according to one embodiment of the present invention.

FIG. 1 is an overhead view of an ammunition presence detector and notification module 100 according to one embodiment of the present invention. Referring now to FIG. 1, a magazine ammunition presence detector 100 is provided in the form of a lightweight, modular printed circuit board (PCB) form of an electronics device. Ammunition presence detector 100 is adapted to leverage a technique for detecting metal generally known as a Colpitts oscillation/induction technique using an oscillator type metal detector circuit 105 mounted on the board to enable accurate determination of ammunition presence in a magazine clip by frequency detection of metal in a magazine follower spring. Ammunition presence detector 100 may be powered by a rechargeable or replaceable battery. In this embodiment, ammunition presence detector receives battery power from a 3V lithium coin cell that fits into a coin bay 101 adapted to receive lithium coin battery cells.

Presence detector 100 includes a micro-controller unit (MCU) 103 powered by the 3V coin cell. MCU 103 has access to appropriate random-access memory (RAM) and Flash memory (not illustrated here) for storing firmware (FW) including signal data processing instructions and creating and storing records and activity cache data. In a preferred embodiment, MCU 103 remains in a sleep mode using scant battery power and has a wake mode triggered by an accelerometer 104. When triggered by motion, accelerometer 104 switches MCU 103 from sleep mode to wake mode enabling the full system to detect and report the presence of ammunition within the magazine. Accelerometer 104 has access to a timer function and may set a time period of activity after every detected movement during active use of a firearm to avoid sending the MCU 103 back into a sleep mode. In one embodiment, a sleep mode may be triggered for the MCU after a certain period of time where there is no movement of the firearm detected. In one embodiment, accelerometer 104 is capable of differentiating between slight movements and movements such as might occur when firing a shot.

Colpitts detector 105 is adapted, in this embodiment, to detect the top edge of a follower spring installed in a typical magazine. Detector 105 serves as the inductor coil in the oscillator that changes inductance values when a targeted metal object comes closer and closer to a detector. When a follower spring is fully compressed due to a full ammunition load in a magazine, the top edge of the metal spring is furthest in distance from metal detector sensor 105. When the top edge of the metal spring moves due to one or more rounds fired from that firearm, the edge of the follower spring moves closer to detector 105 changing the inductance affecting the oscillation frequency output of detector 105. If there is no metal near sensor 105, the inductance will be lower than when there is metal close by. The frequency of oscillation with no metal nearby detector 105 will be higher than when there is metal closer to it. As the inductance increases, the frequency decreases. In this way, ammunition presence sensor 100 is adapted to detect the metal spring within the magazine.

The oscillation frequency output from detector 105 is fed directly into MCU 103 for signal processing including processing by known signal processing components like a zero crossing detector that converts the sine wave of the oscillator to a level shifted square wave signal and prescaling the signal for better granularity in a high speed signal measurement timer. Ammunition presence detector 100 may include an eccentric motor (EM) 102. EM 102 is adapted to vibrate according to instruction received from MCU 103. EM 102 may provide notification to a user of the firearm relative to low or no presence of ammunition left in the magazine at the time of notification. A user may program ammunition presence detector 100 using a computing appliance having a means (tether) of input through a 5 pin connector 107 in this example. A user may program EM warnings to include vibrating in short bursts to count down remaining ammunition rounds left in a magazine, and or to vibrate vigorously can continuously or for a longer period if the magazine is empty and the last round is in chamber. In this embodiment a programmer may calculate exactly when EM 102 is triggered based on desired oscillation frequency threshold. An example may be that EM 102 vibrates vigorously when the last round leaves the magazine tipping a user off through the vibration that the user can feel while holding the firearm by the stock or pistol grip.

In one embodiment, ammunition presence detector includes a light emitting diode (LED) 108 that may be a red LED or an LED of another highly visible color that lights up when a programed "low ammunition presence" threshold is recognized in the signal data. A simple window (drilled opening) may be provided on the firearm stock or pistol grip that enables the LED light 108 to be seen by a user operating the firearm. In one embodiment, a calibration/reset button 106 may be provided for a user to reset the system to original settings or to clear data caches and reprogram different threshold values including no magazine present, full magazine present or other desired threshold values. In a most basic embodiment, ammunition presence detector 100 simply alerts the user during a session when the magazine has one round left or when the last round is in the firing chamber of the firearm.

One with skill in the art of PCB mounted electronics will appreciate that added features for ammunition presence detection system 100 may be provided by adding additional electronics such as a Global navigation satellite system (GNSS), a general term describing any satellite constellation that provides positioning, navigation, and timing (PNT) services on a global or regional basis, which includes global positioning satellite (GPS) network access capability. Additionally, wireless communication capability with a Bluetooth enabled device may be included such as through a Bluetooth chip, and directional orientation sensors that can report a direction of aim of the firearm such as when a shot is fired from the firearm.

Figure 2:
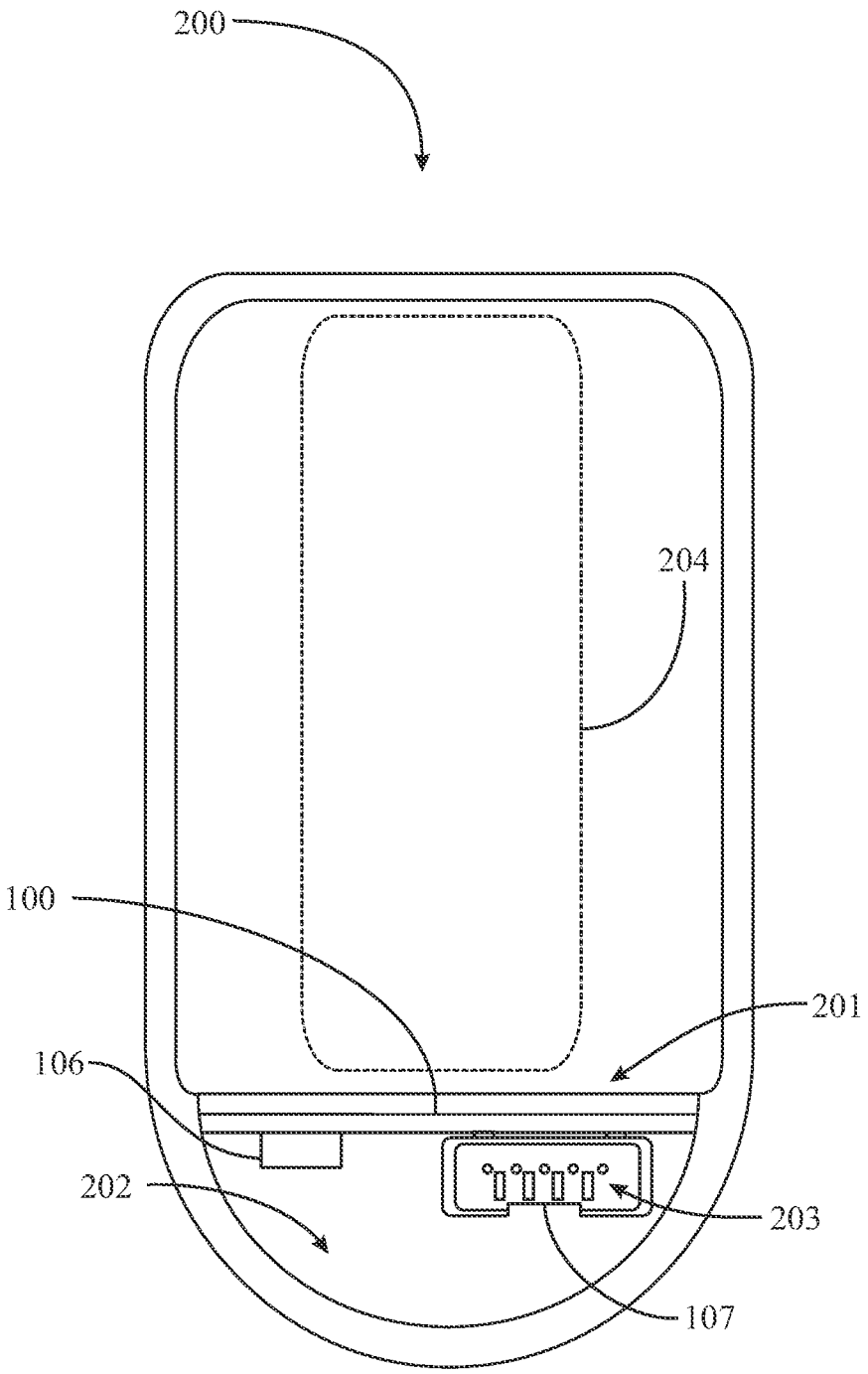
FIG. 2 is an overhead view of an open pistol stock housing the ammunition presence detector module of FIG. 1.

FIG. 2 is an overhead view of an open pistol stock 200 housing the ammunition presence detector module 100 of FIG. 1. Referring now to FIG. 2, a firearm pistol stock 200 is depicted and reveals an open space 201 for insert of a magazine or ammunition clip, and a parallel partitioned space 202 for housing the modular ammunition presence detector 100 described in FIG. 1 above. The partition may be a plastic or rubberized web material relatively thin partition that separates the PCB electronics device from the body of the ammunition magazine. It is important in the embodiment using a metal detection circuit that there is no metal in the partition material. In this embodiment, ammunition presence detection module 100 is retained in a stabilized position inside space 202 using a retainer plug that attaches over the pin connector 107.

The retainer plug conforms to the contours of the inside of the pistol grip in this example and is removed for clarity in this example. An outline (broken boundary) inside space 201 logically represents an inserted ammunition magazine 204. Electronics connector architecture 203 represents the pins and associated pads of connector 107. A user may remove PCB 100 by pulling it out by the retainer plug and may access the board electronically by removing the retainer plug from the pin connector. A user may program, update, upload data from, and charge the ammunition presence detection module through the pin connector. One with skill in the art of electronics devices will understand that other electronic connection types may be swapped for connector 107 without departing from the spirit and scope of the invention. It may also be understood that additional electronics for data communication such as wireless chips may be provided and used, for example to sync data, upload data, download data, and charge the device without departing from the spirit and scope of the invention. Push button 106 may be adapted to enable a user to reset the electronics device or clear it of cached data.

Figure 3A:
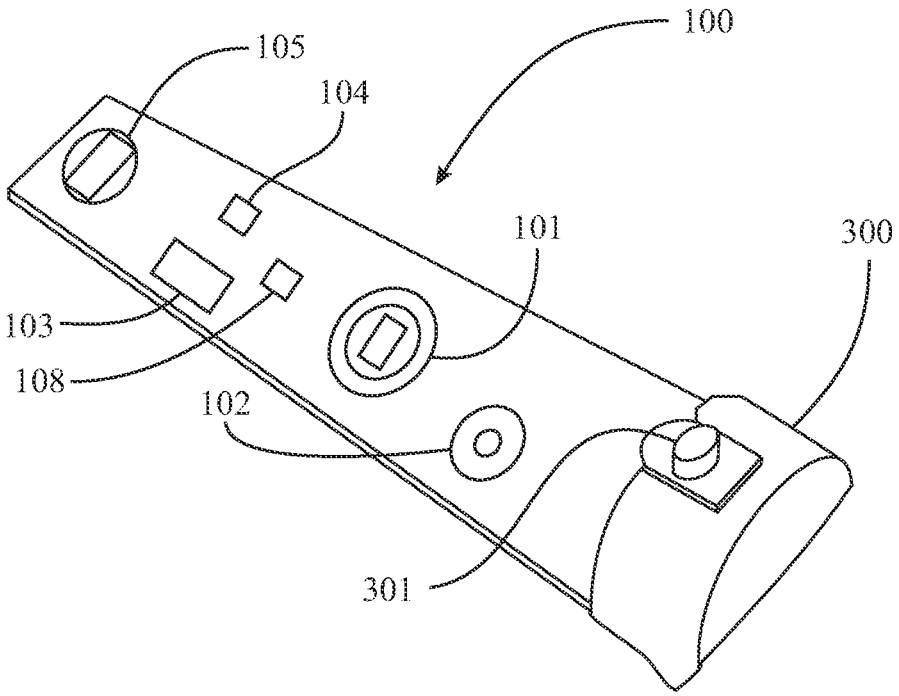
FIG. 3A is a perspective view of the ammunition presence detection module of FIG. 1 capped with a stock retainer plug.

FIG. 3A is a perspective view of ammunition presence detection module 100 of FIG. 1 capped with a stock retainer plug. In this example, ammunition presence detection module 100 is removed from the pistol grip but is still attached to a retainer plug 300. Retainer plug 300 may be a molded part made of a rubber material or a rubber polymer composite material having some flexibility. Retainer plug 300 is shaped to plug the hollow at the bottom rear of the pistol grip and stabilizes ammunition presence detection module 100 into a linear position generally parallel with a magazine inserted into the firearm. In this embodiment, retainer plug 300 includes an annular latch button 301 to support the retainer plug against the rear inside curved wall of the pistol grip. Latch button 301 may be spring loaded and is depressable to allow the plug to be pressed into the hollow space whereby the latch button 301 springs back into an opening placed through the rear wall of the pistol grip for the purpose of preventing the plug from sliding inside the grip. In this way, ammunition presence detection module 100 may be installed into a pistol grip and held stable inside the grip while the firearm is being used.

Figure 3B:
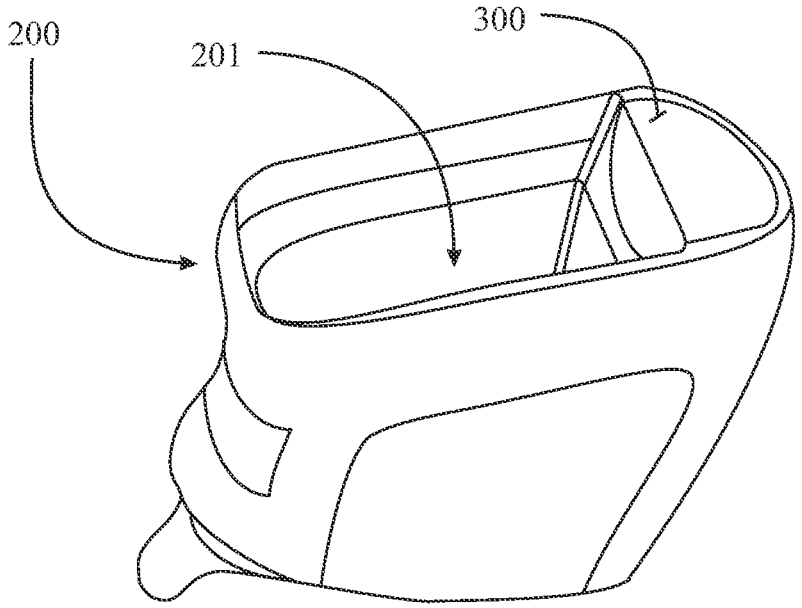
FIG. 3B is a partial perspective view of a pistol grip stock housing the ammunition presence detection module of FIG. 3A retained by the stock retainer plug of FIG. 3A.

FIG. 3B is a partial perspective view of a pistol grip stock housing the ammunition presence detection module 100 of FIG. 3A retained by the stock retainer plug 300 of FIG. 3A. Referring now to FIG. 3B, pistol grip 200 reveals ammunition presence detection module 100 inserted into opening 202 while opening 201 (FIG. 2) is empty with no magazine inserted. In this embodiment, the metal detection circuit 105 is at the far side of the PCB board near the receiver and firing chamber of the firearm. In this embodiment, the near edge of the follower spring is the target for detection. Each time a shot is fired, the follower spring moves closer to the detection circuit as a next cartridge is advanced from the magazine into the firing chamber of the firearm.

Figure 4:
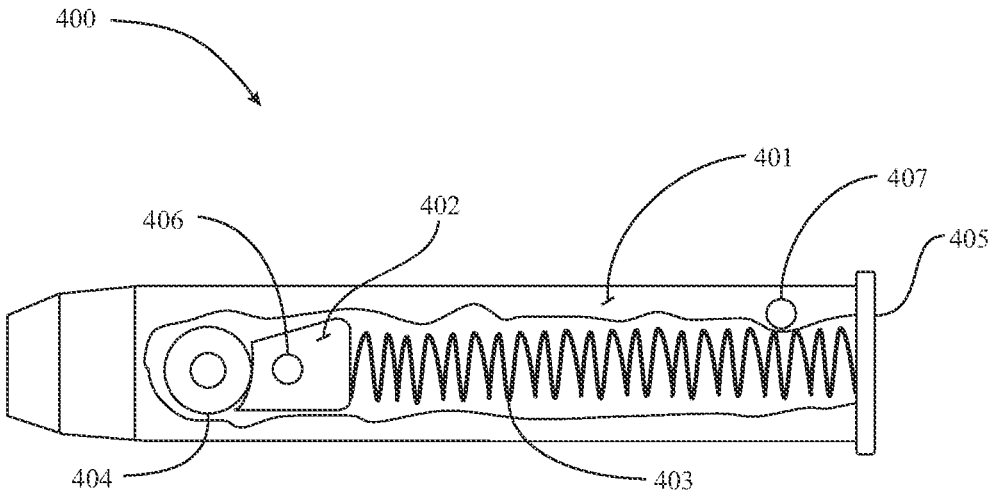
FIG. 4 is a side view of an ammunition magazine modified to practice the invention according to another embodiment of the present invention.

FIG. 4 is a side view of an ammunition magazine 400 modified to practice the invention according to another embodiment of the present invention. In one embodiment of the invention a Collpits oscillator 105 as depicted and described as mounted on the PCB board of ammunition presence detection module 100 in FIG. 1 is not required to practice the present invention. In this embodiment, the oscillator circuit is replaced by a pair of strategically mounted magnetic sensors such as Hall sensors adapted to detect a magnet or magnetized target. Magazine 400 has some wall material 401 removed from the magazine body in this depiction to highlight the components inside the magazine. A typical magazine includes a lock plate 405, a follower spring 403, and a follower 402. A shell 404 is depicted for reference atop follower 402. Magazine 400 is depicted with the rear side facing the viewer in this example.

In this embodiment, follower 402 is modified to support an embedded target 406. Target 406 may be an annular magnet press fit into an opening provided in the wall of the follower. Magazine wall 401 supports a second embedded target 407, also an annular magnet press fit into an opening provided for the purpose in magazine wall 401. In a preferred embodiment, two Hall sensors are mounted onto the PCB of ammunition presence detection module 100 in place of the Colpitts oscillator sensor. One of the Hall sensors is placed in a position to detect follower target 406 when the target is directly across from that PCB mounted sensor referred to further below as a follower sensor. The other Hall sensor is mounted on the PCB toward the rear edge of the board and is adapted to detect magnet 407 when magazine 400 is inserted into the pistol grip.

In this embodiment the accelerometer 104 wakes the MCU and the magazine sensor (second Hall sensor) on the PCB alerts of a fresh magazine inserted into the grip by a user operating the firearm. As rounds are fired, follower target 406 advances to a point directly across from the first Hall sensor on the PCB to be detected by the sensor. Detection is reported to the MCU and notification to the operator of the firearm is made via audio, vibratory and or visual means that the magazine has a specific low number of shells left. More detail about the magazine and follower sensors placed on the PCB of ammunition presence detection module 100 is presented further below.

Figure 5A:
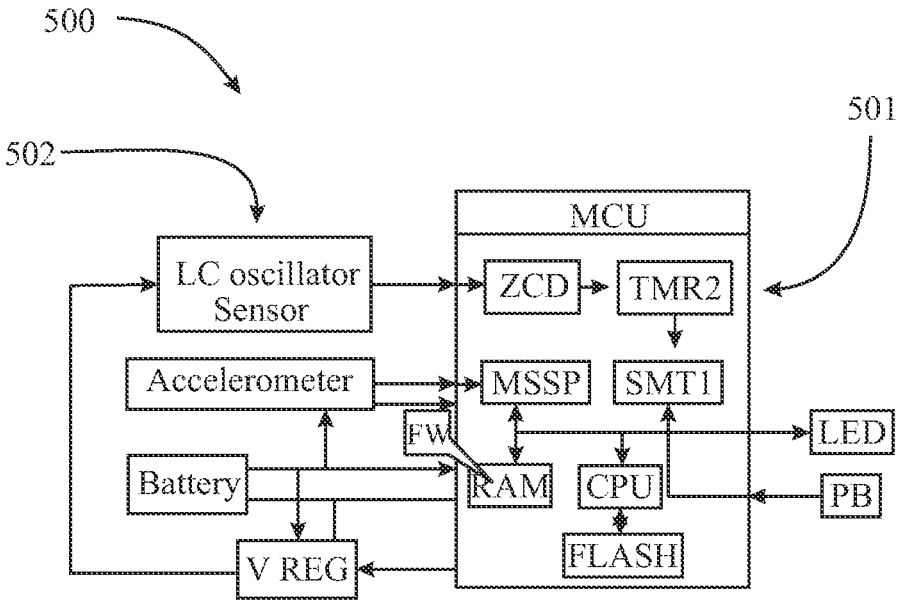
FIG. 5A is a block diagram depicting printed circuit board electronics for the ammunition presence detection module of FIG. 1 using an oscillator sensor.

FIG. 5A is a block diagram depicting printed circuit board electronics for the ammunition presence detection module of FIG. 1 using an oscillator sensor. Referring now to FIG. 5A, a block diagram depicts circuitry 500 provided on the PCB board of ammunition detector 100. The circuitry is segregated in this embodiment between processing, recording, and reporting circuitry on MCU 501, input signal circuitry and power circuitry 502 on the PCB board and connected to MCU 501, and output circuitry including the LED, and EM (vibrating motor).

In general, the functional component other than the processor may be a simple Colpitts oscillator metal detector described as sensor 105 in FIG. 1. Metal detectors use the inductor in the oscillator to change inductance when metal objects come close. If there is no metal nearby, the inductance will be lower than when there is metal close by. The frequency of oscillation with no metal nearby will be higher than when there is metal close to the inductor. As the inductance increases, the frequency decreases.

The output signal of the oscillator may be connected to a zero-crossing detector (ZCD) in the MCU. The ZCD may receive and convert the sine wave generated by the oscillator into a logic level square wave that may be used as a clock for Timer2. Timer2 may divide the frequency down by about 200 so a signal measurement timer (SMT) can make a precise period measurement. The SMT uses the internal high frequency oscillator controlled by an external crystal to clock a 24-bit counter at 16 MHz. A reset pulse in TMR2 acts as the start reset pulse for the SMT. Each TMR2 reset pulse causes the current count in the SMT to be first latched and then reset to count again continuously and sets a period latch interrupt flag (PLIF). The interrupt service routine transfers the 24-bit count to memory for processing and resets the interrupt flag. The faster the SMT is clocked, the sooner data is received for the period measurement. The more bits in the counter, the higher resolution is realized for the period measurement.

In the Collpits oscillator embodiment, the Colpitts oscillator circuit is only turned on if the gun is moved. For example, removing a pistol from a holster or rifle from a rifle hold. This is done to save battery life. Movement is detected by the accelerometer so there is no need to manually power on the system. Once a loaded magazine is installed, the period is measured and stored. After each shot is fired, the period is measured and compared to the stored period. When the last round leaves the magazine, the period will go down more than it did after the other shots. This change in period is used to turn on the warning light (LED) and or an EM as described further above.

Figure 5B:
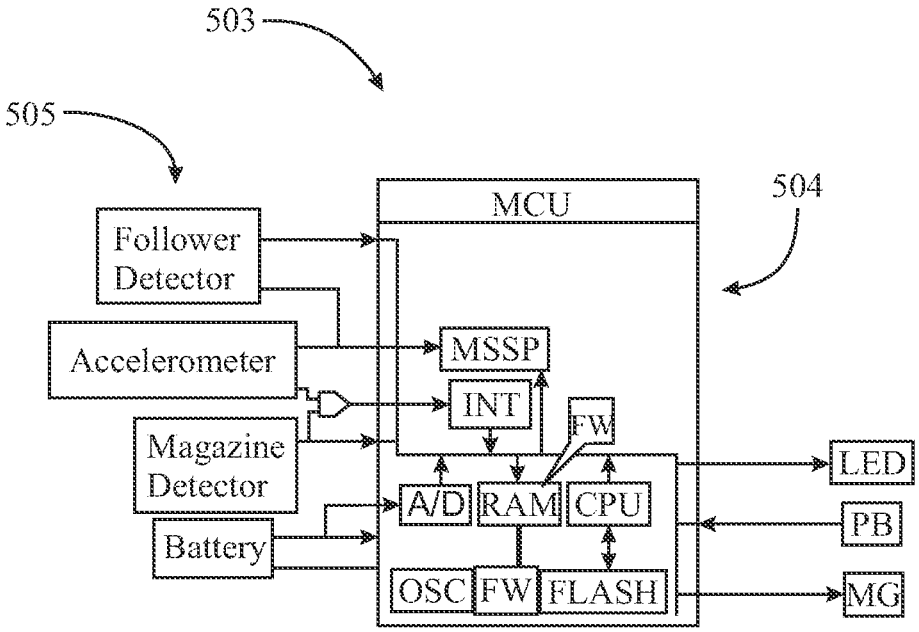
FIG. 5B is a block diagram depicting printed circuit board electronics for the ammunition presence detection module of FIG. 6 using Hall sensors in place of an oscillator sensor.
Figure 6:
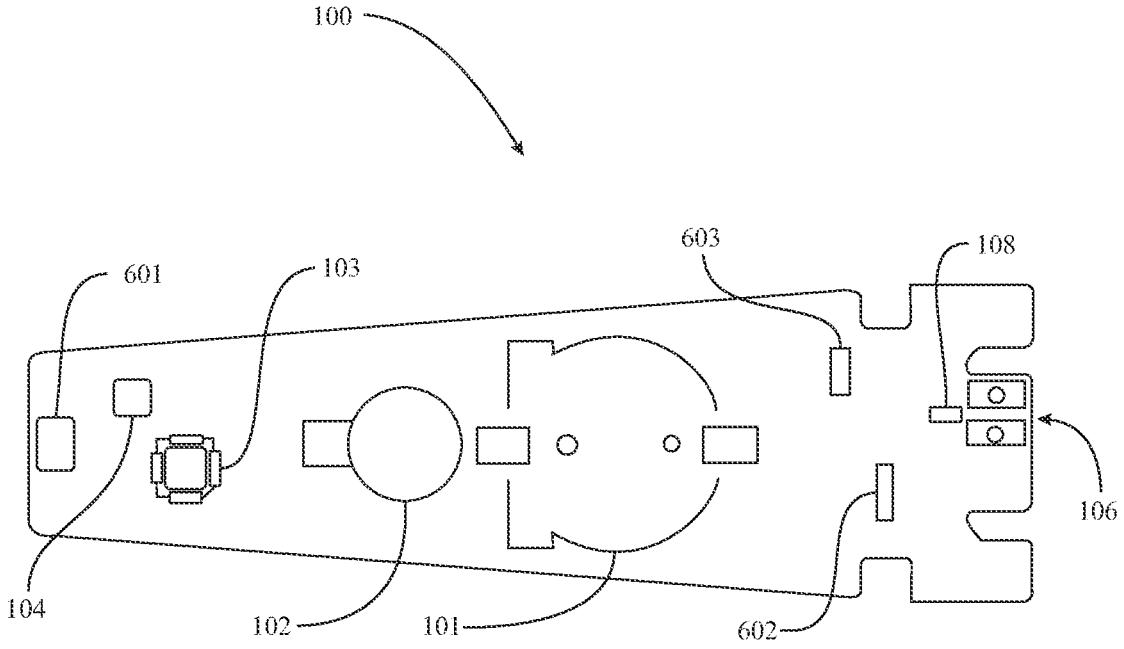
FIG. 6 is an overhead view of an ammunition presence detector and notification module according to the embodiment of FIG. 5B using Hall sensors.

FIG. 5B is a block diagram 503 depicting printed circuit board electronics for the ammunition presence detection module of FIG. 6 using Hall sensors in place of an oscillator sensor. Referring now to FIG. 5B, a block diagram depicts circuitry 503 provided on the PCB board of ammunition detector 100. The circuitry is segregated in this embodiment between processing, recording, and reporting circuitry on MCU 504, input signal circuitry and power circuitry 505 on the PCB board and connected to MCU 504, and output circuitry including the LED, and EM (vibrating motor). In this embodiment, magnets are strategically placed in the magazine follower and in the magazine body while magnetic sensors such as Hall sensors are strategically placed on the PCB board to detect when a magazine is inserted and when the follower has advanced to a point that is detected by the follower sensor.

In this embodiment, the Colpitts oscillator and associated signal processing circuitry describe in reference to FIG. 5A is not required on the PCB or on the MCU. Instead of measuring a frequency to a "target" frequency, the ammunition presence detection module simply detects a single advanced position and reports how many rounds still exists in the magazine by typically vibrating in short but successive bursts, for example 4 bursts of vibration indicating four rounds are left in the magazine. As the next shot fired is detected, the EM may vibrate three times and so on until the last round is in chamber and the magazine is empty. At this point the EM may vibrate vigorously for a longer period indicating an empty magazine.

Each embodiment described above may include programmable firmware (FW) including MCU instructions and processing instructions according to the instant embodiment. FW may be updated, programed, etc. through pin connector 107. One with skill in the art of electronics will appreciate that certain electronics are required in the Colpitts embodiment whereas other electronics are required for the Magnetic detection embodiment so the circuitry supporting each embodiment will look and function differently.

FIG. 6 is an overhead view of ammunition presence detector and notification module 100 according to the embodiment of FIG. 5B using Hall sensors. In this embodiment, the Colpitts oscillator sensor is obfuscated for a pair of magnet sensors 601 and 603. Sensors 601 and 603 may be identical Hall sensors known in the art and to the inventor. In this embodiment, sensor 603 is a magazine sensor adapted to alert the MCU of the presence of an inserted and locked ammunition magazine. Sensor 603 is strategically placed on the PCB to detect magnet 407 embedded in the magazine body 401 in FIG. 4. Sensor 601 is referred to herein as a follower sensor adapted to alert the MCU when the magnet 406 embedded in the follower of the magazine advances to a specific linear point as a result of firearms use and is detected. When follower magnet 406 is detected by sensor 601, there will be a specific number of ammunition rounds still in the magazine. In one embodiment the number is four. However, in other embodiments the sensor 601 might be placed further along or not as far along the linear path on the PCB.

Accelerometer 104, MCU 103, EM 102, battery coin bay 101, and LED 108 retain the same descriptions as in the Colpitts embodiment of FIG. 1 and retain the same element numbers. In this embodiment there are two push buttons 106 depicted instead of just one in FIG. 1. However, the same function or functions may apply to these buttons, for example, to reset the system, erase cache and other programmable functions. Pin connector 107 is replaced in this embodiment, by a smaller pin connector 602. In this embodiment, accelerometer 104 wakes up MCU 103 from sleep mode when a user picks up the firearm. Magazine sensor 603 alerts the MCU of a present magazine and sensor 601 alerts the MCU of a follower detection event that confirms a number of rounds left in the magazine. The MCU may execute a series of vibrations when the follower is detected to inform the user how many rounds remain in the magazine. At that point accelerometer 104 alerts the MCU each time another shot is fired from the firearm and the MCU may execute the vibration series reflecting the remaining ammunition count less one until there are no ammunition rounds in the magazine. In variations of this embodiment, LED 108 may be used to warn that the magazine is completely empty by flashing red for example. In one variation, an audio speaker might be added to the PCB and may play a sound or recite words notifying of remaining rounds and empty magazine.

It is important to note herein that while no additional features are depicted in circuitry in this embodiment, that ammunition presence detection module 101 may include one or more communication chips and FW such as a Bluetooth chip, Global Satellite Positioning (GPS) circuitry, a modem for accessing a networked sever, a gyroscope or compass for determining orientation of the firearm, and other such additions depending upon the manufacturer and PCB engineering entity. However, in the basic embodiments described herein ammunition presence detection module 101 alerts at least the user to the conditions of remaining ammunition in the magazine in real time.

Figure 7:
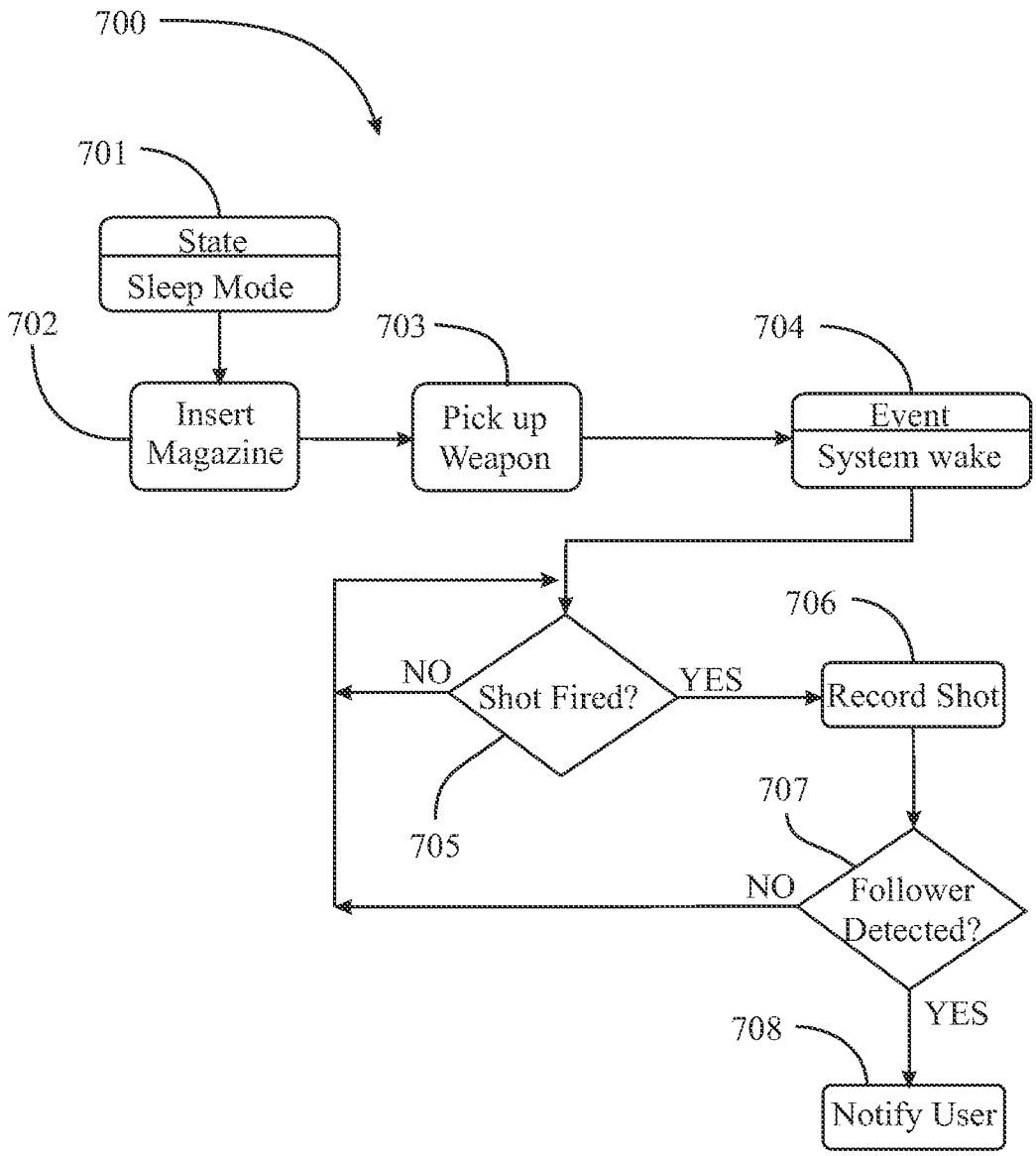
FIG. 7 is a process flow chart depicting steps for using the ammunition presence detection and notification module according to the embodiment of FIG. 5B using Hall sensors in place of an oscillator sensor.

FIG. 7 is a process flow chart 700 depicting steps for using the ammunition presence detection and notification module according to the embodiment of FIG. 5B using Hall sensors in place of an oscillator sensor. This process assumes that the ammunition presence detection module has been calibrated, charged, and is retained in the pistol grip of the firearm. At step 701 the ammunition presence detection module is in a state of sleep mode. Sleep mode for electronics is well known in the art and to the inventor. At step 702, a user inserts a magazine into the pistol grip magazine hold modified, as disclosed above, to be detected by the sensor. At step 703, now that the magazine is in place an interrupt can be accepted from the accelerometer when the weapon is picked up and the magazine sensor senses the magnet embedded into the wall of the magazine (see FIG. 4) and wakes the MCU from sleep mode at step 704, and the processor on the PCB wakes up. If there is no motion exciting the accelerometer, a timer will expire and the system will go back into sleep mode waiting for the next movement event.

At step 705, the system determines if a shot is fired depending on the accelerometer to alert when the recoil motion is determined to be of the level of a shot being fired from the weapon. In a variation of this embodiment, a compass or gyro sensor may be provided to determine orientation of the weapon once a shot is detected and the MCU may log that in session data. If at step 705, a shot is detected, the process loops back and continues to monitor. If at step 705, it is determined a shot was fired, the accelerometer reports to the MCU and the MCU records the shot at step 706. In a variation of this embodiment, the GPS of the user and direction of the weapon when the shot was detected is also recorded. In this variation, the session data may be synced to a user's phone running an application using Bluetooth technology. In another variation, the session data may be simply stored for access. In another variation, it may be uploaded on to a network server in real time or near real time.

At step 707, a decision may be made whether the follower has been detected indicating a set number of rounds remaining in the magazine. If at step 707, the follower has not been detected by the follower sensor on the PCB, then the process loops back to a monitoring state. This loop will occur until the follower magnet in the magazine is detected. Once the follower is detected in step 707, the user is notified of the number of remaining rounds at step 708. In one embodiment, the MCU executes a series of short vibrations in succession equal to the number of remaining rounds in the magazine. In this linear model, the detection point of the follower will be equal to the number of stacked rounds on top of the follower minus the round in chamber. Therefore, the position on the PCB of the follower sensor (601, FIG. 6) determines how many rounds are in the magazine when the follower Magnet is detected. The notification may include vibration, visual notification and or audio notification depending on features added through electronics.

Referring now back to FIG. 5A, the Colpitts embodiment includes general configuration and process data revealed in the priority document and reproduced for consideration below. In the magnetic sensing embodiment frequency detection and signal processing associated therewith are not required in order to practice the invention.

When the regulator is enabled, it puts out a constant 1.8V which is used to run the Colpitts oscillator Q1. When U1 detects motion, it sends an interrupt to U2 waking it up. After the controller wakes up, it enables the regulator U4, and the Colpitts oscillator starts. If the accelerometer U1, detects movement, it resets its timer. The timer in the accelerometer keeps the circuit running between movements so it doesn't go to sleep and wake up when the firearm is being used in session. The controller (MCU) and accelerometer communicate over a I2C link and the interrupts. The controller is programed through a programming header. The accelerometer is configured by the controller over the I2C link.

The primary functions used are the "Sleep to wake" and "return to sleep". Sleep to wake is triggered by the motion sensors. This in turn generates the Wake interrupt going to the MCU. It also starts a timer in the MCU and when it times out, the MCU starts the back to sleep function. It is possible to use just 1 interrupt and pass messages to the MCU to tell it which mode is required, wake or sleep. When the motion sensor is detecting motion, the timer is constantly reset until there is no more motion. When it is in the wake mode, it may be possible to detect the difference between normal hand movement and a shot fired.

WAKE Mode Tasks

Check For Loaded Mag present

Read the period SMT24PER

Compare to No Mag Threshold period

If no mag, clear the alarm flag, exit Check

Else compare to Empty Mag Threshold period
If not empty, clear the alarm flag, exit check
Else set the alarm flag
Exit check
Calibrate Empty Mag Threshold period
If the button was pressed and released
Read the period (with an empty mag)
Add the cal (calibration) factor
Save the Empty Mag Threshold period
else calibrate
Wake Sleep task
Read accelerometer message
If it is the same as the last message, exit
else if sleep message, go to sleep, exit
if wake message, wake up, exit
Interrupt Service
Alarm tasks
If alarm flag is reset, turn off the LED, exit
else turn on the LED, exit
Read timer period
If timer is set
Reset GIE read timer and save to variable timer period
Reset timer, set GIE, exit
else exit
Reset timer, set GIE global interrupt enable, exit
Wake Sleep tasks
If accelerometer interrupt flag is set
Reset GIE, save message
Reset interrupt flag, set GIE, exit
Else exit Firmware may be programmable from a separate device connected to the ammunition presence detector 100 via pin connector 107 described in FIG. 1. In one embodiment, data in flash memory may be offloaded over a wireless link or tethered link to a cell phone application or a laptop application for recording purposes, training purposes, legal purposes, or other evaluation purposes.

Figure 8:
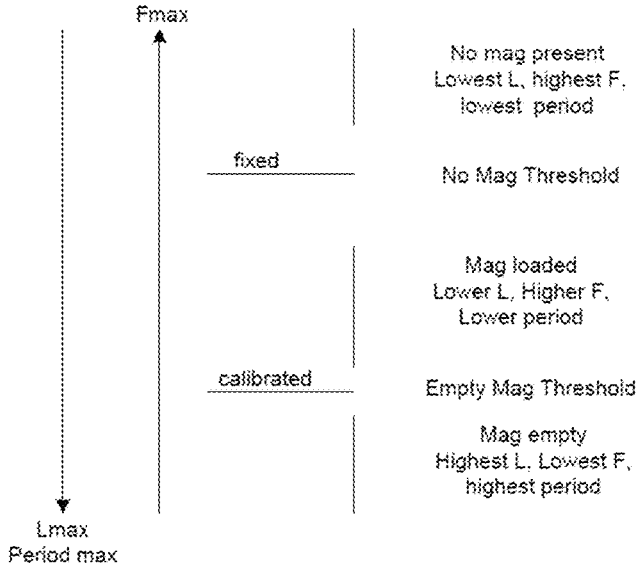
FIG. 8 illustrates how the system senses the status of the magazine.

FIG. 8 is a graphic to show how the system senses the status of the magazine.

The frequency of the Colpitts oscillator is highest when there is no mag present. What we see is a smear or range of frequency data on the high side. When we insert a loaded mag into the gun, the range of frequencies we measure drops below the No Mag Threshold. When the last round leaves the mag, the range of frequencies measured drops below the Empty Mag Threshold. Since the measurement is fuzzy, we need to move the fuzzy frequency ranges as far apart as possible so we can set a threshold that is between the ranges as shown.

It turns out that the No Mag present range has enough separation from the Loaded Mag range that a fixed threshold is possible to set. This can be determined by taking a long-term average of the frequencies we measure with no mag present and then subtract a fixed offset to set the No Mag Threshold. Determining the Empty Mag Threshold must be done with more care because the ranges are closer together. First the long-term average of a loaded mag, ML, needs to be stored. Then a long-term average of an empty mag, ME needs to be stored. Then the Empty Mag Threshold=(ML−ME)/2+ME. This calibration process may need the use of the button which is TBD at this date. There are three primary stimulative other than the presence of metal near the coil of the Colpitts oscillator that need to be minimized. The tolerance of the components in the oscillator circuit will have a fixed frequency offset and the temperature of those components will have a variable frequency offset. The third case is the differences in material of the magazine and the gun from one gun and or magazine to the next. The third case is fixed when the magazine is inserted in the gun. The processor must cancel out, or take into account, the temperature caused frequency variations. In another embodiment, a small camera may be mounted in the magazine enabling optical detection of ammunition and sending data to the processor via a wireless connection. In this embodiment, the count and alerts remain the same.

It will be apparent with skill in the art that the ammunition presence detection module of the present invention may be provided using some or all the elements described herein. The arrangement of elements and functionality thereof relative to the ammunition presence detection module of the invention is described in different embodiments each of which is an implementation of the present invention. While the uses and methods are described in enabling detail herein, it is to be noted that many alterations could be made in the details of the construction and the arrangement of the elements without departing from the spirit and scope of this invention. The present invention is limited only by the breadth of the claims below.

The invention claimed is:

1. A module for detecting and notifying of the presence of ammunition comprising:

a printed circuit board having electronics mounted thereon including a central processing unit with access to memory having executable instruction data thereon, at least one motion sensor for sensing motion of the printed circuit board, an eccentric motor, a connector providing remote digital access to the processor, at least one mechanism for erasing data or resetting parameters, and a battery bay for accepting a battery, at least one sensor enabled to detect position of a spring or follower in a magazine, and a retainer plug attached to the printed circuit board and adapted to stabilize the board inside the structure of a firearm stock;

wherein an amount of ammunition is discerned by the central processing unit based upon the position of the spring or follower.

2. The module of claim 1, wherein the at least one motion sensor is an accelerometer.

3. The module of claim 1, wherein the at least one sensor for sensing position of the spring is a Colpitts oscillator.

4. The module of claim 1, wherein the at least one sensor for sensing position of the follower is a Hall magnetic sensor.

5. The module of claim 1, wherein the eccentric motor is a vibrating motor.

6. The module of claim 1, wherein there are two motion sensors, one sensing a magnet positioned on an inner wall of the magazine and a second magnet positioned on the follower.

7. The module of claim 1, wherein the executable instruction data is firmware.

8. The module of claim 1, wherein the retainer plug attaches to the printed circuit board at one end and fits into a structural pocket within a grip stock of a pistol.

9. The module of claim 1, wherein the battery is a 3V lithium coin cell.

10. The module of claim 3, wherein the detection of ammunition depends upon confirming a frequency equal to an approximation of an advancing edge of a metal spring within the magazine.

11. The module of claim 1, wherein the detection of ammunition depends upon confirming line of sight position of an advancing magnet embedded in the follower within the magazine.

12. A method of using a module comprising a printed circuit board having electronics mounted thereon including a central processing unit with access to memory having executable instruction data thereon, at least one motion sensor for sensing motion of the printed circuit board, an eccentric motor, a battery bay for accepting a battery, and at least one sensor for detecting the presence of a magazine and ammunition, to detect and provide confirmation of detection of a number of ammunition rounds remaining in an ammunition magazine coupled to a firearm including:

(a) picking up the firearm with the module inserted therein;

(b) placing an ammunition magazine into a magazine pocket in the firearm;

(c) monitoring for recoil motion identifying a shot and recording instances thereof;

(d) detecting an event equated to a specific number of ammunition rounds linearly stacked on a follower within the magazine; and (e) upon detection at (d), notifying a user of the firearm the state of ammunition presence remaining within the magazine.

13. The method of claim 12, wherein in (a) an accelerometer detects the motion of picking up the firearm and wakes the central processing unit.

14. The method of claim 12, wherein in (b) a first magnetic sensor detects the presence of a magazine with ammunition.

15. The method of claim 12, wherein in (c), the instances of recorded shots are time stamped.

16. The method of claim 12, wherein in (d), the number of rounds left in the magazine is equated to a frequency based on approximation of the edge of a follower spring to the ammunition presence detection oscillator on the printed circuit board.

17. The method of claim 12, wherein in (d) the number of rounds left in the magazine is equated to a magnetic connection between a Hall magnetic sensor and a target magnet embedded in the follower.

18. The method of claim 12, wherein in (d) notification is provided by executing an eccentric motor to vibrate according to executable instruction data on memory accessible to the central processing unit.

19. The method of claim 12, wherein in (d) notification repeats each time step (c) occurs after the first notification, each subsequent notification subtracting the shot fired from the number of rounds cited in the first notification.

20. The method of claim 19, wherein in (d), the number of rounds cited is four rounds.

* * * * *